US005441165A

United States Patent [19]

Kemp et al.

[11] Patent Number: 5,441,165

[45] Date of Patent: Aug. 15, 1995

[54] AUTONOMOUS CONTROLLED DRUG DISPENSING SYSTEM

[76] Inventors: Vivian Kemp, 1928 Abshire La., Dallas County, Dallas, Tex. 75228; Janie Nichols, 702 Woodhaven Ave., Dallas County, Duncanville, Tex. 75116; Martha Brushwood, 523 Woodhavaven Ave., Dallas County, Duncanville, Tex. 75116; David Hullender, 2709 Westridge Dr., Tarrant County, Arlington, Tex. 76012

[21] Appl. No.: 734,152

[22] Filed: Jul. 22, 1991

[51] Int. Cl.[6] ..... G07F 11/56

[52] U.S. Cl. ..... 221/2; 221/82; 221/89; 221/97; 221/102; 221/113; 221/130

[58] Field of Search ..... 221/2, 13, 21, 82, 89, 221/92, 102, 113, 129, 130, 131, 132, 133, 15, 97

[56] References Cited

U.S. PATENT DOCUMENTS

| | | | |
|---|---|---|---|
| 3,871,156 | 3/1975 | Koenig et al. | 221/2 X |
| 3,998,356 | 12/1976 | Christensen | 221/2 |
| 4,598,378 | 7/1986 | Giacomo | 221/129 X |
| 4,663,621 | 5/1987 | Field et al. | 221/2 X |
| 4,793,761 | 12/1988 | Stern | 221/82 X |
| 4,811,764 | 3/1989 | McLaughlin | 221/2 X |
| 4,869,395 | 9/1989 | Rubbmark | 221/131 |
| 4,893,727 | 1/1990 | Near | 221/82 X |
| 4,995,498 | 2/1991 | Menke | 221/133 X |
| 5,205,436 | 4/1993 | Savage | 221/102 X |

FOREIGN PATENT DOCUMENTS

| | | | |
|---|---|---|---|
| 2099803 | 12/1982 | United Kingdom | 221/15 X |

*Primary Examiner*—William E. Terrell
*Assistant Examiner*—Dean A. Reichard
*Attorney, Agent, or Firm*—S. Pal Asija

[57] ABSTRACT

A stand-alone drug dispensing system suitable for a nursing station at a health care facility is described. A microprocessor controlled secure system makes it particularly suitable for dispensing narcotics and other controlled substances. The system comprises a cylinder having a plurality of stacked carrousels, each having plurality of drug slots. Each carousel holds a different drug and it is the rotation of these carrousels over a hole or chute that runs the entire length of the cylinder that allows the dispensing of a particular drug under the control of a programmed microprocessor. The system provides accurate accounting as well as advisory information about the drug being dispensed. A plurality of peripherals such as a Video Display Terminal, an alphanumeric printer, and an alphanumeric keyboard are integrated into the system. Also included are an alarm system, a back up power source and a slot for returning unused drugs.

3 Claims, 6 Drawing Sheets

AUTONOMOUS CONTROLLED DRUG DISPENSING SYSTEM

RELATED DOCUMENT

This utility patent application for invention is based on the concept disclosed in Disclosure Document Number 167878 then entitled, "THREE-IN-ONE- COMPUTER NARCOTIC BOX".

BACKGROUND

The dispensing of controlled substances is subject to various state and federal regulations for obvious reasons. Health care facilities have developed various manual procedures and multiple locks to comply with security and accounting requirements, which unfortunately interfere with rapid dispensing of drugs. Automated systems for dispensing drug doses in response to programmed information have been developed they are very complex and affordable only for large scale applications. They are not stand-alone units suitable for installation at a nursing station at a health care facility. A prior art search was conducted and the following U.S. patents were uncovered.

a) U.S. Pat. No. 4,695,954 granted to Rose et al on Sep. 22, 1987 for "Modular Medication Dispensing System and Apparatus Utilizing Portable Memory Device"

b) U.S. Pat. No. 4,546,901 granted to Patrick Buttarazzi on Oct. 15, 1985 for "Apparatus for Dispensing Medication"

c) U.S. Pat. No. 4,733,362 granted to Manabu Haraguchi on Mar. 22, 1988 for "Drug Dispensing Apparatus with a Printer having programmable format."

d) U.S. Pat. No. 4,473,884 granted to Robert Behl on Sep. 25, 1984 for "Electronic Medication Dispensing System"

e) U.S. Pat. No. 4,847,764 granted to Jerry Halverson on Jul. 11, 1989 for "System for Dispensing Drugs in Health Care Institutions"

f) U.S. Pat. No. 4,785,969 granted to John McLaughlin on Nov. 22, 1988 for "Medication Dispensing System"

g) U.S. Pat. No. 3,712,507 granted to W W Holt on Jan. 23, 1973 for "Article Dispensing Apparatus and Methods"

h) U.S. Pat. No. 4,572,403 granted to Rafael Benaroya on Feb. 25, 1986 for "Timed Dispensing Device for Tablets, Capsules and the Like"

i) U.S. PAt. No. 4,747,514 granted to Forest Stone on May 31, 1988 for "Electronically Controlled Programmable Dispenser for Medications"

j) U.S. Pat. No. 4,763,810 granted to Lee Christiansen on Aug. 16, 1988 for "Medication Dispenser"

k) U.S. Pat. No. 3,917,045 granted to Williams et al on Nov. 4, 1975 for "Drug Dispensing Apparatus"

Unfortunately prior art embodiments do not meet all of the objectives established by the inventors for this autonomous controlled drug dispensing system as follows.

a) It is an objective of this invention to provide a stand-alone, rapid, automated secure system of drug dispensing suitable for installation at a nursing station in a health care facility.

b) Another objective of this invention is to provide record keeping and strict accounting of all drugs used as well as returned unused drugs.

c) Another objective of this invention is to provide advisory and precautionary drug information prior to or concurrently with the dispensing of the drug.

d) Another objective of this invention is to automatically provide inventory update and patient billing data on demand.

e) Another objective of this invention is to incorporate a return slot for unused drugs.

f) Another objective of this invention is to permit only authorized nurses to access the system.

g) Another objective of this invention is to simplify and speed up the replenishing of the drugs periodically.

h) Another objective of this invention is to incorporate an alarm system to alarm the supervisory personnel if the system is tampered with.

i) Another objective of this invention is to include a real time clock to automatically record date and time of each drug dispensed.

j) Another objective of this invention is to provide a back up power source such that the system can be used in case of a power failure.

k) Another objective of this invention is to provide an automatic data back up periodically on a computer readable media.

l) Another objective of this invention is to facilitate compliance with all state and federal regulations associated with dispensing of drugs in health care facilities.

m) Another objective of this invention is to make the unit theft proof by securely integrating and anchoring it to the cabinetry of the nursing station at a health care facility.

n) Another objective of this invention is to obviate the need for finding the supervisory nurse with the keys before a nurse can obtain drugs for a critical patient.

o) Another objective of this invention is that the system be flexible and programmable such that it can be reprogrammed to meet the changing needs of a health care institution.

p) Other objects of this invention reside in its simplicity, elegance, aesthetics, ease of use, ease of maintenance, ease of manufacture, ease of replenishing inventory, high reliability and flexibility as will become apparent from the following brief description of the drawing and the detailed description of the alternate and preferred embodiments.

SUMMARY

A microprocessor controlled programmable autonomous stand alone drug dispensing system particularly suited for a nursing station at a health care facility for dispensing controlled drugs which comprises a plurality of vertically stacked carrousels each having a plurality of drug slots, wherein each carousel contains a different drug and each carousel is individually controllable. A hole or chute runs the entire length of the cylinder formed by the stacked carrousels and it is the rotation of these carrousels over said chute that allows the dispensing of a particular drug under the control of a pre-programmed microprocessor.

The system has strict security and provides accurate accounting of all drugs dispensed and returned. The system also generates and/or maintains drug information, patient billing information, up/to/date inventory a list of authorized nurses and other information related to drug dispensing transactions. A plurality of peripherals such as a video display terminal, an alpha-numeric printer, an alpha numeric key board an alarm system and a back up power supply are integrated into a single unit aesthetically design and permanently anchored to the nursing station.

BRIEF DESCRIPTION OF THE DRAWING a) FIG. 1 is a perspective view of the autonomous stand alone drug dispensing system of this invention depicting video display terminal, printer, alpha-numeric keyboard, drug return slot and drug dispensing chute.

b) FIG. 2 is a cross sectional side view of a carousel, a plurality of which are stacked to form a cylinder in the unit.

c) FIG. 3 is a view of the unit along lines 3—3 of FIG. 1 which includes a plan view of the top carousel.

d) FIG. 4 is a close up top plan view of the section of the carousel drive mechanism which is driven by a stepper motor under the plate separating any two consecutively stacked carrousels.

e) FIG. 5 is a perspective view of a section of the unit where in one of the carrousels is extended open to replenish the inventory.

f) FIG. 6 is a perspective view of one of the carrousels without any inventory.

g) FIG. 7 shows a perspective view of the cylinder formed by stack of carrousels each separated by a rectangular plate.

h) FIG. 8 is an exploded view of a carousel and associated plate along with accessories such as power connections, stepper motor, position indicator and drug label etc.

i) FIG. 9 is a subsystem interconnection circuit diagram showing video display terminal, printer, alphanumeric key board, back up power supply and the alarm system.

j) FIG. 10 is a system flow chart showing various menus and modules and their relationship to drug dispensing transactions.

DETAILED DESCRIPTION OF THE PREFERRED EMBODIMENT

Figure 1:
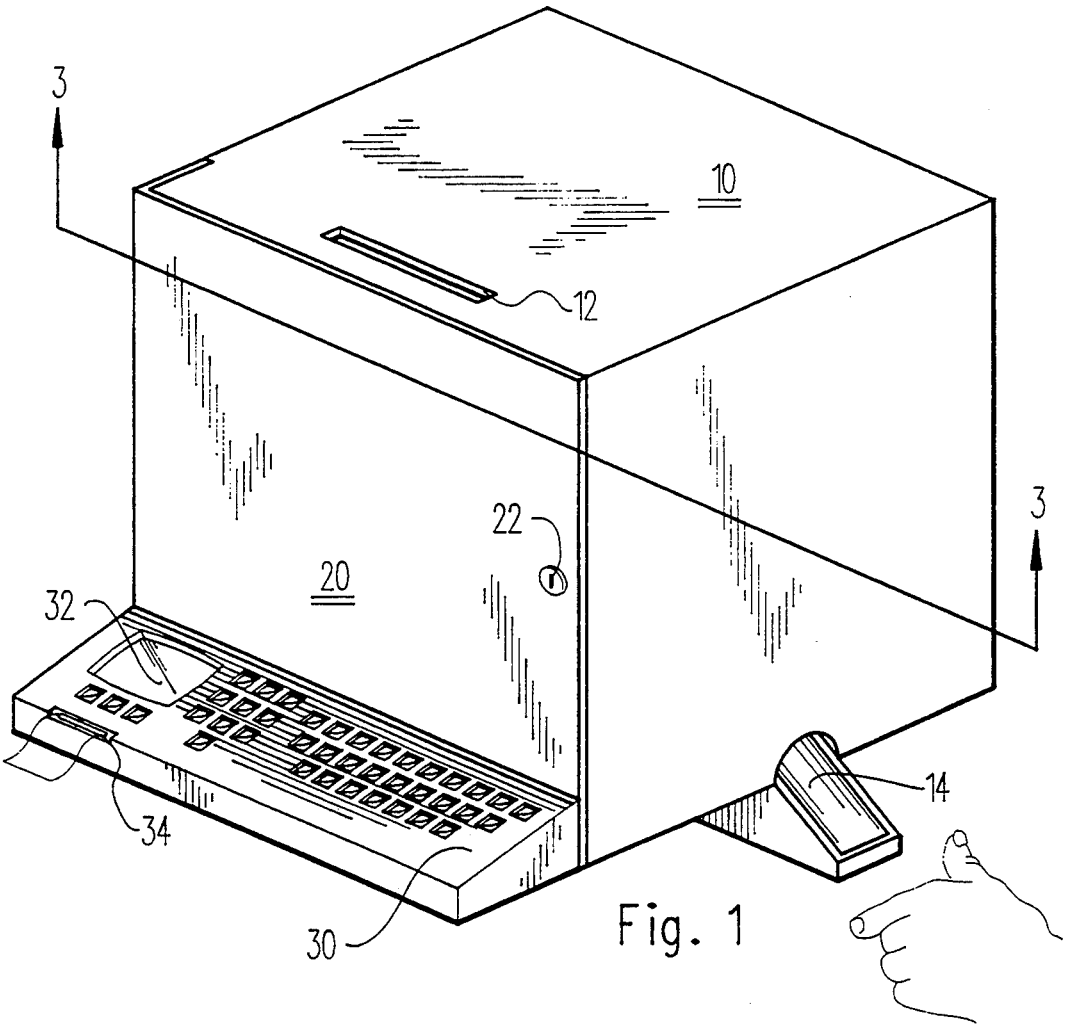

As shown in FIG. 1, the autonomous controlled drug dispensing system of this invention comprises a box 10 having a drug return slot 12, a drug delivery chute 14, a front door 20 with lock 22 as well as a complete alphanumeric QWERTY keyboard 30 including a video display terminal 32 and a printer 34.

Figure 3:
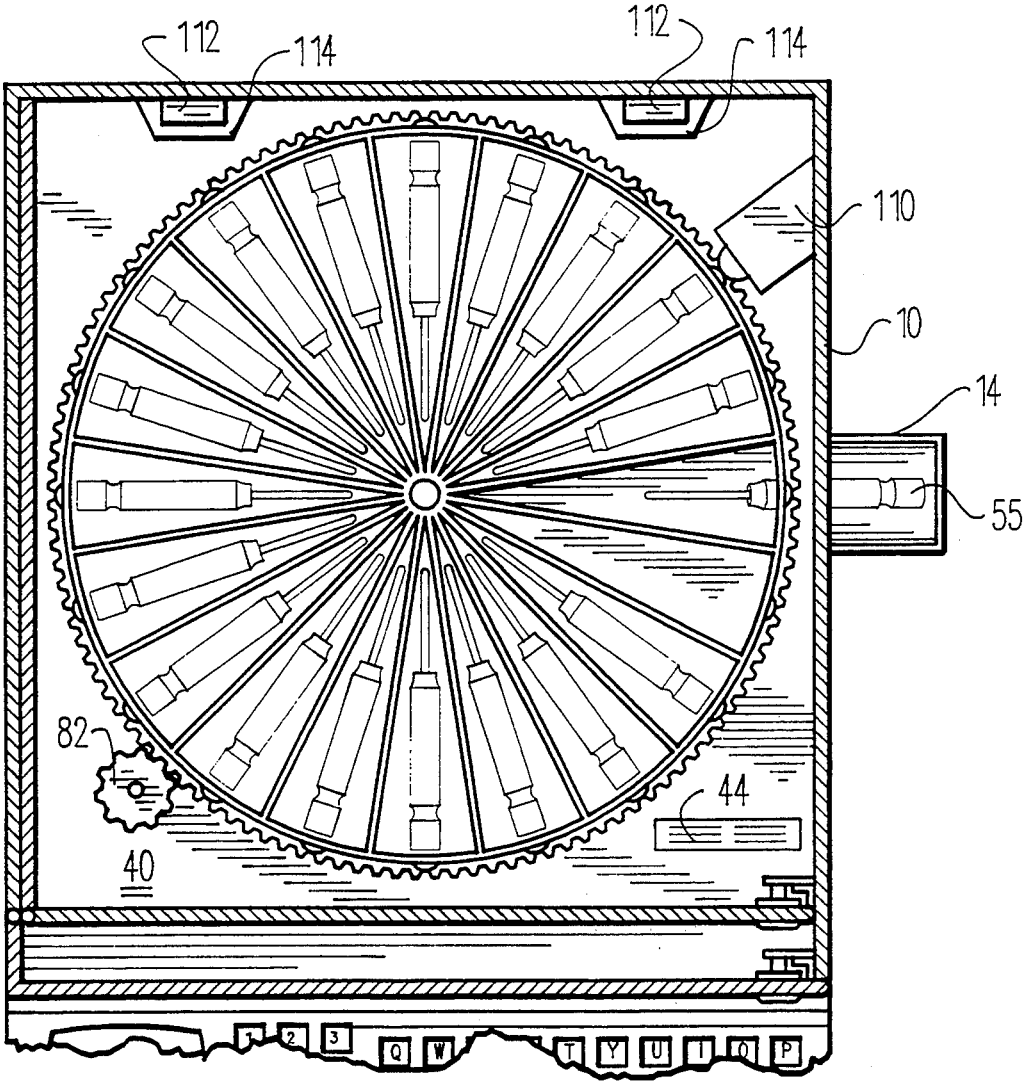

Behind door 20, there are plurality of front loading drawers 40 each drawer holding a carrousel 50, each carrousel having a plurality of slots 52. FIG. 3 shows a top view of one such drawer and carousel 50. The drawers and carrousels are vertically stacked. Each carrousel contains a different drug. Each carrousel is independently controllable and rotatable under the control of the microprocessor/computer 60 and controller 70. Each drawer-plate 40 has an opening 42 which corresponds in area to one slot 52 of carrousel 50. When properly stacked the opening 42 in each plate 40 is vertically aligned which in turn empties into chute 14.

Figure 2:
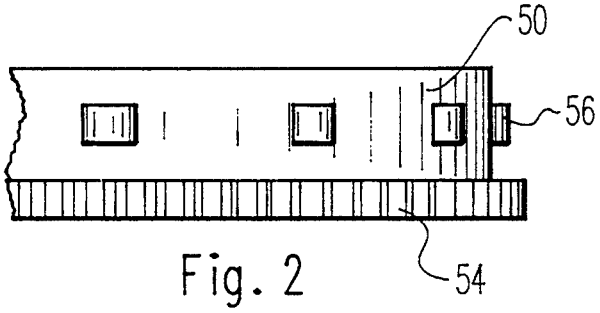

As shown in FIGS. 2 and 3, each carrousel 50 has plurality of consecutive teeth 54 all along the bottom circumference of said carrousel 50. Each carrousel also has plurality of projections 56 at the center circumference of carrousel 50 centered at the arc of each slot 52 such that the number of projections equals the number of slots on a carrousel. These projections are used to align the next slot containing the drug ready for dispensing above the opening 42 of plate 40. Since all plates are similarly aligned the drug falls through the chute formed by vertical stack of drawer plates and carrousels and empties into drug delivery chute 14.

Figure 4:
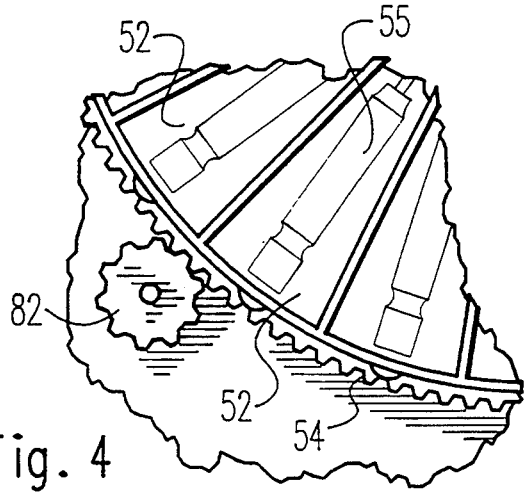
Figure 5:
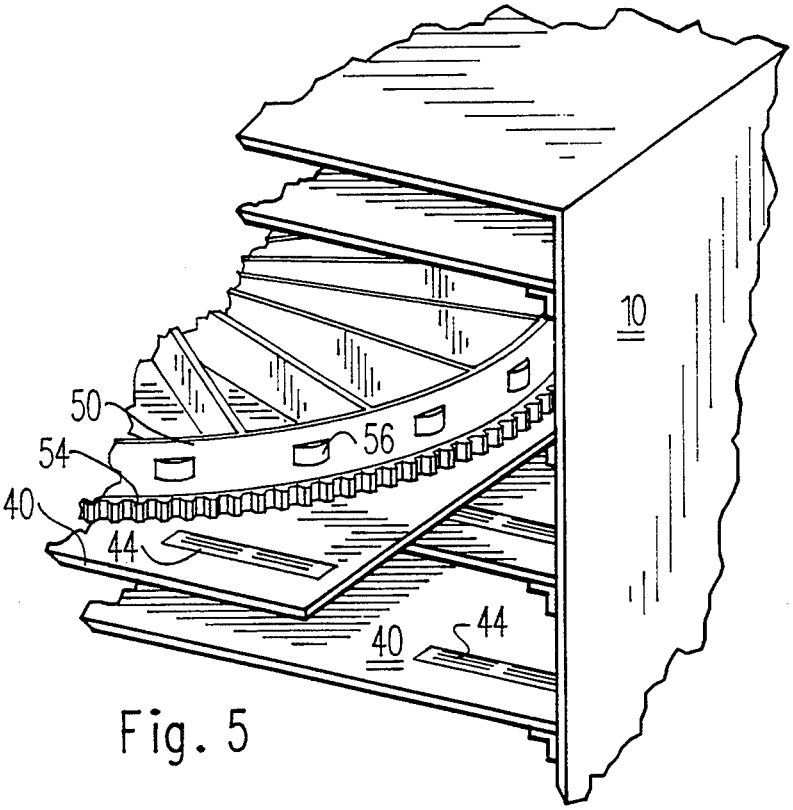
Figure 6:
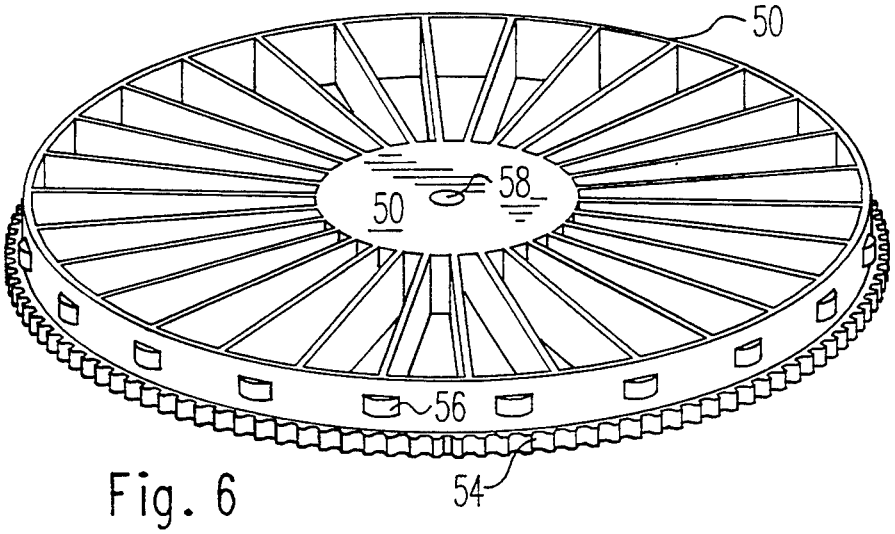
Figure 7:
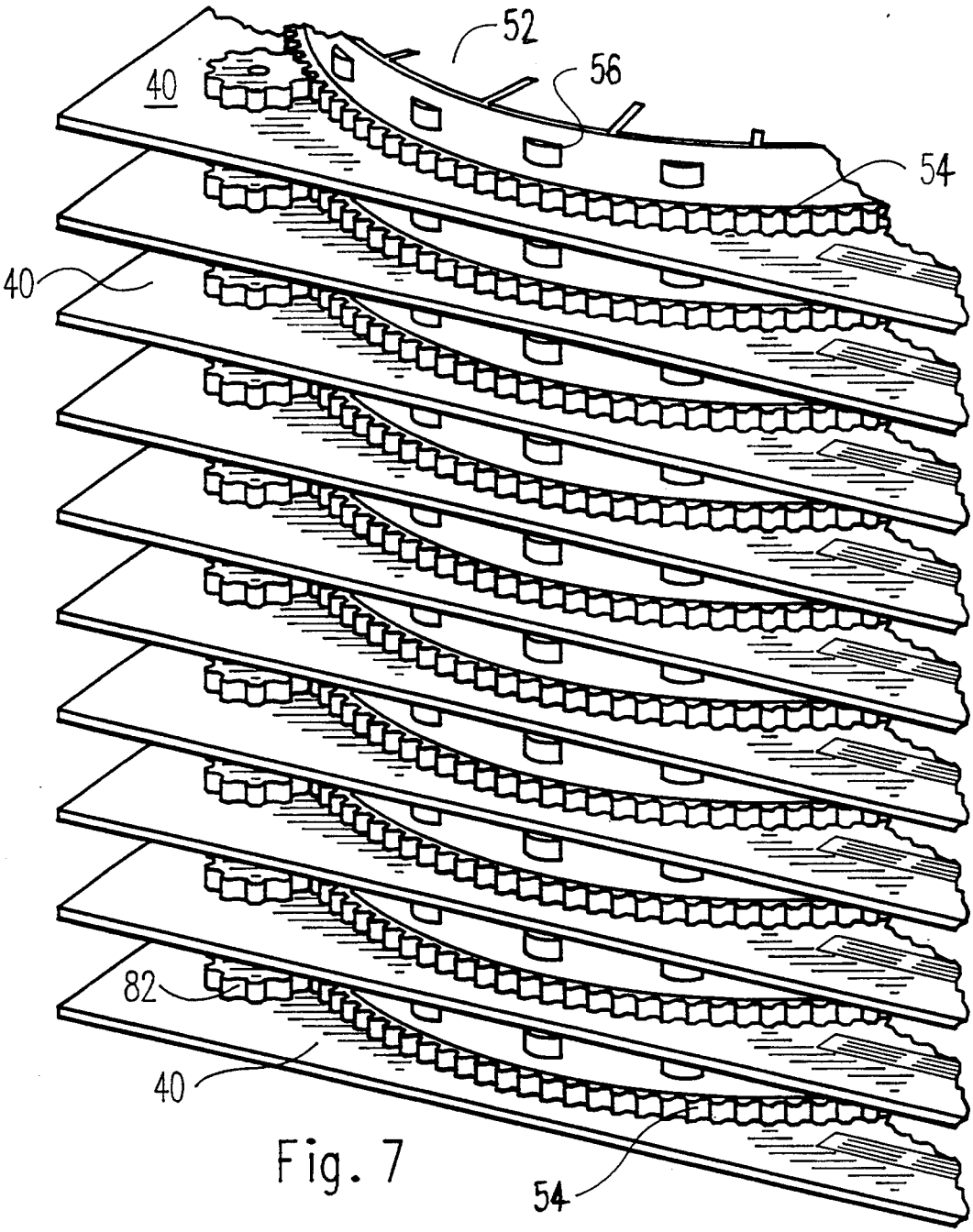
Figure 8:
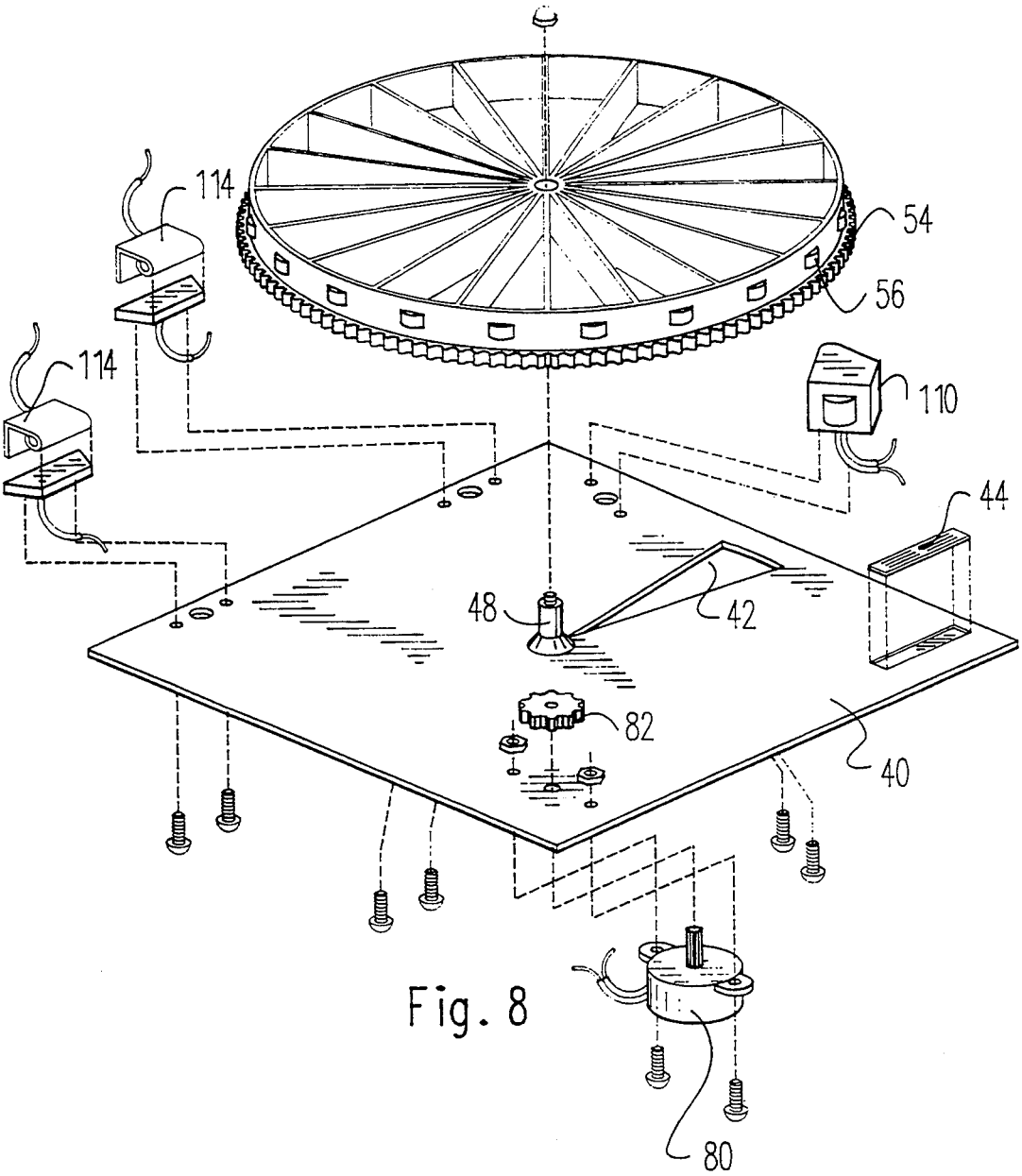

FIG. 4 shows a close up view of the carousel drive mechanism and the interface between teeth 54 of carrousel and sprocket wheel 82 driven by motor 80. FIG. 5 shows a drawer plate with concomitant carousel extended forward for servicing or replenishing inventory etc. FIG. 6 shows a plan view of the carrousel 50 which at its hub has a hole 58 which in turn aligns with pin 48 on plate 40 and in turn ensures smooth rotation of the carousel 50. FIG. 7 shows a plurality of drawer-plates and concomitant carrousels vertically stacked inside the box 10.

As can be seen in FIGS. 3 and/or 8 each carrousel 50 also has an associated motor 80, which powers a sprocket wheel 82 which meshes with teeth 54 of carrousel 50. Each drawer plate 40 also has a label 44 for labeling the drug in the carousel 50 resting on the drawer plate 40. The carrousel 50 has no bottom except drawer plate 40 serves as the bottom of carrousel 50. Each drawer plate and carrousel also has associated with it an electronic or electromechanical position sensor 110 which aligns with projections 56 on carrousel 50 which in turn enables the computer 60 via controller 70 to stop the carrousel when the next slot containing the drug is aligned with the opening 42 on the drawer plate 40 under carrousel 50.

The position sensor 110 is mounted on an inside wall of box 10 but snugly fits against the carrousel when the drawer is fully pushed in. Each drawer also has associated with it a pair of insulated electrical connectors 112 also mounted on inside back wall of box 10, which supplies power to corresponding motor via insulated electrical matching connectors 114 on plate 40 when the drawer is fully pushed in.

Figure 9:
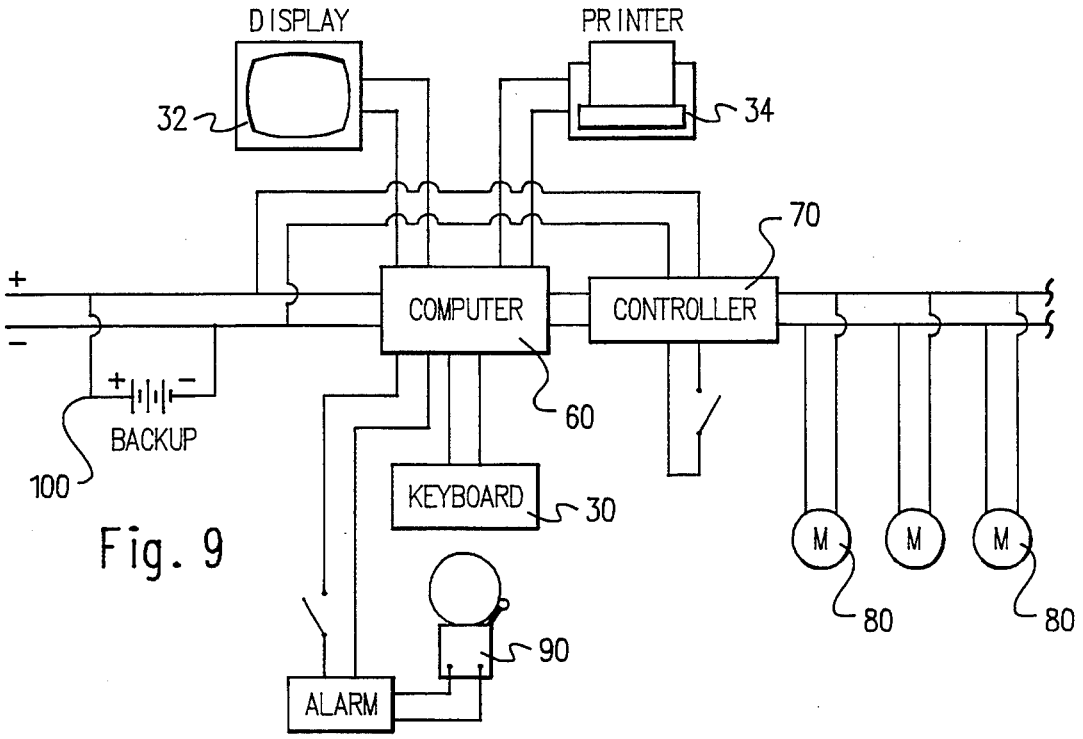
Figure 10:
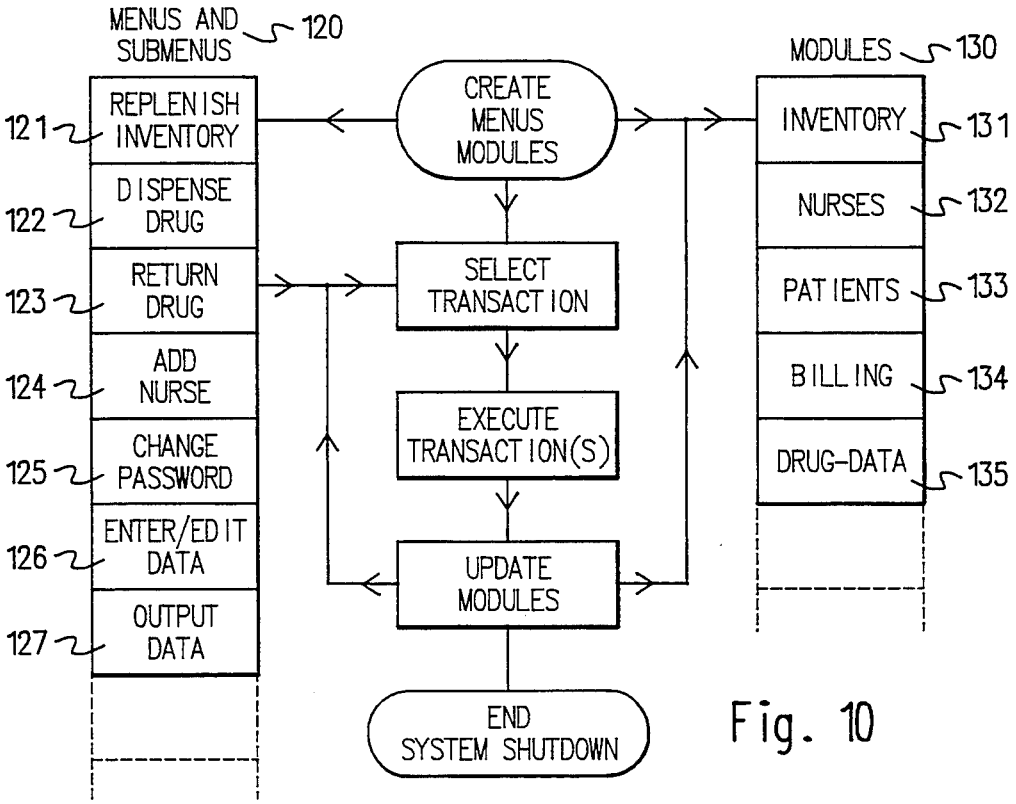

FIG. 9 shows subsystem interconnection diagram which also includes an alarm subsystem 90 which is activated upon any unauthorized tampering as well as a backup power supply 100. FIG. 10 shows system flow chart including plurality of menus and submenus and plurality of modules 130. Examples of transactional menus are but not limited to the following:

a) Replenishing Inventory
b) Dispensing Drug
c) Returning Drug
d) Adding a nurse
e) Changing password
f) Entering or editing data
g) Outputing data Examples of Modules 130 are but not limited to the following a) Inventory Module
b) Nurses Module
c) Patients Module
d) Billing Module
e) Drug data Module As shown in FIG. 10 system flow chart an operator merely selects a transaction from a menu and commands the system to execute the transaction. The computer then executes the transaction and updates all affected modules before permitting same or another operator another transaction.

OPERATION

The system is typically installed into the cabinetry of a nursing station at a health care facility. Menus and modules are created and/or modified and initial conditions set specifically for each installation under the control of the software associated with microprocessor 60. Carrousels are filled with appropriate drugs. Only one drug per carrousel is allowed in this configuration. The label 44 is marked with drug 55. The door is locked and the alarm 90 is activated.

As an authorized nurse enters the commands for the desired drug for a desired patient via the keyboard 30, the microprocessor 60 first presents information about the drug and then via controller 70 and motor 80 aligns the slot next containing the drug in that carrousel is rotated one slot above the opening 42 in plate 40 such that the drug 55 falls through the virtual chute formed by alignment of all the opening 42 in plates 40 such that the drug empties into the chute 14 integrated into box 10. To ensure proper accounting, it should be noted that drugs are dispensed consecutively in this configuration.

The inventors have given non-limiting description of various embodiments and their permutations and combinations. Many changes may be made to this design configuration without deviating from the spirit and purpose of this invention. Examples of such contemplated variations include the following:

a) Multiple drugs may be dispensed from the same carrousel.
b) The system may be adapted for secure storage and delivery of other items other than controlled drugs such as jewelry.
c) The system may be adapted for larger more complex pharmaceutical applications.
d) The sub-system configuration may be varied while still performing essentially the same functions substantially the same way with substantially the same or similar results.
e) Newer components and materials may be substituted as they become available.
f) The embodiment of this invention may be used for a different but related purpose.
g) Shape or size of the unit may be varied.
h) Some purely aesthetical features may be added to the hardware or the software without deviating from the spirit of this invention.
i) Multiple locks and/or doors may be used for even greater security.
j) The printer may be replaced by another hardcopy output device.
k) The microprocessor may be replaced by a larger computer for larger applications
l) A microprocessor may be shared between two or more bedside drug delivery units.
m) A single motor may be moved and shared between multiple carrousels.
n) A different hardware may be used for connecting various components to drawer plate 40 in box 10.

Following is a listing of the components and subsystems used in the preferred embodiment along with their typical values and specifications where appropriate arranged in the ascending order of the reference numerals.

10=Outer box of the autonomous self-contained stand alone unit.
12=Drug return slot on box 10
14=Drug Delivery Chute
20=Front door
22=Lock on the front door
30=Alpha-numeric QWERTY keyboard
32=Video Display Terminal
34=Printer or other hard copy output device.
40=Drawer Plate
42=Wedge shaped opening on drawer plate 40
44=Label of drug in the carrousel.
48=Pin on drawer plate 40
50=Carrousel
52=Plurality of slots in a carrousel
54=Teeth at the lower perimeter of carrousel 50
55=Drug in a carrousel.
56=Alignment projections on carrousel 50 corresponding to each carrousel slot 52
58=Center hole on carousel 50
60=Microprocessor or computer
70=Controller interface between computer and motors
80=Motor (one per carousel)
90=Alarm subsystem
100=Back-up emergency power supply.
110=Position sensor and indicator
112=Insulated power connectors on box 10 matching connectors 114
114=Insulated power connectors on drawer plate 40 matching connectors 112
120=Menus
121=Replenish Inventory Menu and/or Transaction
122=Dispense Drug Menu and/or Transaction
123=Return Drug Menu and/or Transaction
124=Add Nurse Menu and/or Transaction
125=Change Password Menu and/or Transaction
126=Enter/Edit Data Menu and/or Transaction
127=Output Data Menu and/or Transaction
130=Modules
131=Inventory Module
132=Nurses Module
133=Patients Module
134=Billing Module
135=Drug-Data Module While the autonomous controlled drug dispensing system of this invention has been described with reference to illustrative embodiments, this invention is not intended to be construed in a limiting sense. Various modifications and combinations of the illustrative embodiments as well as other embodiments of this invention will be apparent to the persons skilled in the art upon reference to this description. It is therefore contemplated that the appended claims cover any such modifications and embodiments as fall within the true scope of this invention.

The inventors claim:

1. An autonomous stand-alone controlled drug dispensing system particularly adapted for a nursing station at a health care facility comprising:

a) a plurality of front loading vertically stacked drawers each said drawer including a carrousel, and each said carrousel comprising a plurality of slots;
b) a motor connected to each said carrousel in said drawer for independently rotating said carrousel one slot at a time;
c) a controller means connected to each said motor;
d) a programmable microprocessor connected to said controller means;
e) an alpha-numeric keyboard connected to said microprocessor;
f) a video display terminal connected to said microprocessor; and
g) a printer connected to said microprocessor;

and wherein further said carrousels in said drawers, said motors, said controller means, said microprocessor, said alphanumeric keyboard, said video display terminal and said printer are integrated into a box which further comprises:

a) a dual lock and key front door connected to said box, b) a drug dispensing chute connected to said box at a lower portion thereof; and c) a drug return slot separate from said drug dispensing chute in an upper portion of said box.

2. A microprocessor controlled drug dispensing system particularly adapted for installation at a nursing station of a health care facility comprising:

a) a unitary box including a drug dispensing chute at a lower portion thereof and a separate drug return slot in an upper portion thereof, integrated into the cabinetry of said nursing station;

b) a microprocessor housed in said unitary box;

c) an alphanumeric key board mechanically and physically connected to said unitary box and electrically and electronically connected to said microprocessor;

d) a video display terminal and a printer mechanically and physically connected to said unitary box and electrically and electronically connected to said microprocessor;

e) a plurality of vertically stacked carrousels each separated by a horizontal base plate wherein further each said carrousel has a plurality of slots;

f) a motor means connected to said carrousel and concomitant said horizontal base plate for independently rotating any one of said carousels by one slot at a time;

g) a controller means interconnecting said microprocessor and said motor means;

h) and wherein further said drug dispensing chute is aligned with an empty slot in each of said carrousels because the corresponding surface area below said empty slot is removed from each said drawer;

i) and wherein further said microprocessor is further programmed to permit access to certain pre-authorized personnel via modifiable preassigned passwords wherein further drug advisory information and accounting information in addition to patient information is output on at least one of said video display terminal and said printer prior to dispensing of the desired drug.

3. A method of dispensing controlled drugs at a nursing station in a health care facility comprising the steps of:

a) stacking a plurality of carrousels vertically, each said carrousel having a plurality of drug slots and filing each said carrousel with a different drug;

b) providing a computer and a control means for independently rotating any one of said carrousels one slot at a time and thereby dispensing corresponding drug contained in that slot;

c) connecting to said computer an alphanumeric keyboard as an input device and an output device;

d) programming said computer to maintain a status of plurality of modules including an inventory module, a nurses module, a patients module, a billings module and a drug advisory data module;

e) further programming said computer to present to a user a selected one of many menus and sub-menus;

f) further programming the computer to process and execute a transaction selected by the user via said alpha-numeric key board;

g) updating any and all affected modules by said transaction;

h) further programming said computer to permit access to certain pre-authorized personnel via modifiable preassigned passwords; and i) providing drug advisory information from said advisory data module onto said output.

* * * * *